US012000007B2

(12) United States Patent
Powell

(10) Patent No.: US 12,000,007 B2
(45) Date of Patent: Jun. 4, 2024

(54) HIGH PRESSURE INSTANTANEOUSLY UNIFORM QUENCH TO CONTROL PART PROPERTIES

(71) Applicant: Integrated Heat Treating Solutions, LLC, Akron, OH (US)

(72) Inventor: Joseph A. Powell, Akron, OH (US)

(73) Assignee: Integrated Heat Treating Solutions, LLC, Akron, OH (US)

( * ) Notice: Subject to any disclaimer, the term of this patent is extended or adjusted under 35 U.S.C. 154(b) by 0 days.

(21) Appl. No.: 16/967,440

(22) PCT Filed: Feb. 6, 2019

(86) PCT No.: PCT/US2019/016881

§ 371 (c)(1),
(2) Date: Aug. 5, 2020

(87) PCT Pub. No.: WO2019/157075

PCT Pub. Date: Aug. 15, 2019

(65) Prior Publication Data

US 2021/0087644 A1 Mar. 25, 2021

Related U.S. Application Data

(60) Provisional application No. 62/629,974, filed on Feb. 13, 2018, provisional application No. 62/626,736, filed on Feb. 6, 2018.

(51) Int. Cl.
*C21D 1/60* (2006.01)
*C21D 1/613* (2006.01)
(Continued)

(52) U.S. Cl.
CPC ..... *C21D 9/10* (2013.01); *C21D 1/60* (2013.01); *C21D 1/613* (2013.01); *C21D 1/667* (2013.01);
(Continued)

(58) Field of Classification Search
CPC . C21D 9/10; C21D 1/60; C21D 1/667; C21D 1/673; C21D 2211/008
See application file for complete search history.

(56) References Cited

U.S. PATENT DOCUMENTS 3,294,599 A * 12/1966 Huseby ..... C21D 1/667 148/590
4,052,235 A * 10/1977 Nakaoka ..... C21D 1/667 148/661
(Continued)

FOREIGN PATENT DOCUMENTS

CN 102198465 A 9/2011
CN 204185524 U 3/2015
(Continued)

*Primary Examiner* — Nicholas A Wang
*Assistant Examiner* — Maxwell Xavier Duffy
(74) *Attorney, Agent, or Firm* — Sisson & Banyas, Attorneys at Law, LLC

(57) ABSTRACT

A process for reducing film boiling by keeping the quenchant pressure above the vapor pressure of the liquid quenchant, and/or using a controlled quenchant renewal to more uniformly cool the surface of part at the initial moment of contact and apparatuses to conduct the pressure and controlled quenchant renewal are disclosed. It is believed that these processes will improve the heat treating of parts with intricate geometries to provide predictable part distortion. The applicability of the method to gun barrels, tubes, round rings, and hollow axles is explained.

2 Claims, 7 Drawing Sheets

(51) Int. Cl.
*C21D 1/667* (2006.01)
*C21D 1/673* (2006.01)
*C21D 9/10* (2006.01)

(52) U.S. Cl.
CPC ..... *C21D 1/673* (2013.01); *C21D 2211/008* (2013.01)

(56) References Cited

U.S. PATENT DOCUMENTS

| | | | | |
|---|---|---|---|---|
| 4,786,338 | A * | 11/1988 | Anzawa | B21B 45/0224 148/504 |
| 6,264,767 | B1 * | 7/2001 | Frank | C21D 8/021 148/547 |
| 6,364,974 | B1 | 4/2002 | Kobasko | |
| 6,656,413 | B2 | 12/2003 | Kay | |
| 2010/0132854 | A1 * | 6/2010 | Cola, Jr. | C21D 1/08 148/590 |
| 2011/0018178 | A1 | 1/2011 | Muller et al. | |
| 2011/0232354 | A1 | 9/2011 | Heilscher et al. | |
| 2014/0367898 | A1 | 12/2014 | Herbert et al. | |
| 2017/0066028 | A1 | 3/2017 | Ishizuka et al. | |
| 2017/0175214 | A1 | 6/2017 | Katsumata et al. | |
| 2019/0024203 | A1 * | 1/2019 | Reinartz | C21D 1/673 |

FOREIGN PATENT DOCUMENTS

| | | | | |
|---|---|---|---|---|
| CN | 109072330 | A | 12/2018 | |
| JP | 2005 313223 | A | 11/2005 | |
| JP | 5878254 | B2 * | 3/2016 | B01L 3/502761 |
| WO | WO-2015120205 | A1 * | 8/2015 | B32B 15/012 |
| WO | 2016/192993 | A1 | 12/2016 | |
| WO | 2017/129600 | A1 | 8/2017 | |
| WO | WO-2017129600 | A1 * | 8/2017 | C21D 1/19 |

* cited by examiner

HIGH PRESSURE INSTANTANEOUSLY UNIFORM QUENCH TO CONTROL PART PROPERTIES

CROSS REFERENCES AND PRIORITIES

This application claims the benefit and priority from U.S. Provisional Application No. 62/626,736 filed on 6 Feb. 2018, and U.S. Provisional Application No. 62/629,974 filed on 13 Feb. 2018, and International Application No. PCT/US2019/016881 filed on 6 Feb. 2019, the teachings of each of which are incorporated by reference herein in their entirety.

BACKGROUND

The use of quenching processes in the steel and metal heat treating industry is well-known. One such process is described in U.S. Pat. No. 6,364,974 (the "974 Patent"), the teachings of which are hereby incorporated by reference in their entirety. The '974 Patent teaches to use "Direct Convection Cooling" [which] is maintained when there is sufficient coolant movement at the surface of the part being quenched to eliminate shock boiling, film boiling, and nucleate boiling on the part's surface.

According to the '974 Patent, [t]he rate of "direct convection cooling" should be maintained until cooling is interrupted in the time frame calculated by the above formula [noted in the '974 Patent]. If the timing of interrupting the quench of the steel parts being hardened is off from the time prescribed by the formula, the level of surface compressive stresses in the steel parts being hardened will be less than the potential "maximum" level of surface compressive stresses possible for the steel parts being hardened from the Martensite core swelling.

The quenching apparatus of the '974 Patent for hardening metal parts can provide "direct convection cooling" for the parts in several ways, including rapid or cyclic immersion with or without quenching solution agitation, quenching solution spray, impingement jets, high flow of the quenching solution, gravity feed of the quenching solution, and the quenching solution being maintained under pressure to increase the boiling point of the quenching solution. The quenching solution is preferably water or a water based solution, and can be used with or without additives, such as polymer based additives, which affect the boiling rate. In addition, particulate additives, such as small copper powder, can be used in the quenching solution, if desired, to assist in breaking up and precluding boiling on the surface of the parts.

It is known that a metal's morphology changes during heating and cooling. The crystals will heat and move to a different phase, and then upon cooling and the type of cooling, the crystals will reform. As the crystals' temperature change, they also change in shape, size, specific gravity and stress state (i.e. compressive versus tensile). These changes happen in milli-seconds. Historically, slow cooling rates have been used to help control the size and other morphology changes. However, in long parts, or parts of complex geometries, such as pinion gears, even slow cooling does not reduce part distortion enough.

While the known processes, such as those described in the '974 Patent, work well for quenching parts having uniform surfaces, they are less useful for quenching complex parts such as those having non-uniform surfaces such as surfaces that include one or more valleys, crevices, grooves, blind holes, through holes or the like. In the known processes, film boiling will occur in these non-uniform surfaces when the quenching liquid is water or a water based solution. The film boiling insulates the part from the quenching liquid (also known as the quenchant) due to the Leidenfrost Effect which prevents the quenching liquid from reaching the surface of the part in the valley(s), crevice(s), groove(s), blind hole(s), through hole(s), under flanges, etc. As a result, the surface of the part in the valley(s), crevice(s), groove(s), blind hole(s), through hole(s), etc., cools at a different rate from the rest of the part surface. This can result in the part warping, cracking, and in extreme cases fracturing during quenching.

Understanding the '974 Patent requires understanding the stress state of a part, in particular at its surface. Every part has a stress state immediately after heating, during the quench, and then after cooling. This stress state will change with time during the heating and cooling processes.

The stress state during heating, after heating, and during the quench is known as the current stress state. It is dynamic as it is always changing.

The stress state after cooling is known as the residual stress state.

The stress state is a function of the grain structure and can be compressive, that is pulling the surface inward to the core of the part, or tensile which pushes the material outward away from the core. The part cracks, shears, or even explodes, when the tensile stress is greater than yield strength of the material.

The difference between a tensile residual stress state and a compressive residual stress state is significant. A punch under tensile residual stresses survives only a fraction of the number of strikes as a punch under compressive residual stresses.

The '974 Patent discusses establishing surface compressive stresses which hold the part in place while the core shrinks and swells as it cools. These surface compressive stresses reduce and even eliminate part cracking. The part cracks or fractures when the force the swelling is greater than the yield strength of the metal at the surface. Cracking is particularly pronounced when the part has tensile stresses on the surface which allow the part to explode as opposed to compressive stresses which pull the surface inward.

The theory behind the rapid quenching relies upon understanding the well-known Eutectoid Iron-Carbon Diagram and m diagrams as shown in FIGS. 1 and 2. FIG. 1 has regions N, FA and S which are the temperature ranges for normalizing, full annealing, and spheroidizing heat treatments, respectively.

It is well known that quenching at a rate fast enough to miss the "nose of the curve" and stay out of the intermediate phases, also known as staying in the Austenite phase until reaching the Martensite start temperature for a particular alloy's TTT diagram transforms the steel from the Austenite phase (A) to the hardened Martensite phase without forming intermediate phases such as bainite, pearlite or ferrite. That is, one should keep the temperature of the surface of the part to the left of the nose of the curve on the TTT diagram and move it directly from Austenite to Martensite.

This "nose of the curve" is shown in FIG. 1 in sections b and c at approximately 1 sec and 1100° F.

In FIG. 2 this "nose of the curve" is the curve coinciding with Ms, the Martensite start, and lies approximately at the horizontal line intersecting the "r" in the word temperature on the Y axis and the vertical line intersecting the letter "u" in the word austenite.

This minimum time at the "nose of the curve" can also be termed its point of inflection. Once the part temperature is below the nose of the curve on the T diagram and still in the Austenite phase (no bainite or pearlite formation) the Martensite phase formation can start once the part's grains cool to the Martensite start temperature (Ms).

However, this rate of quench cooling is often impeded by film boiling, which forms an insulative layer of gas on the part surface.

Prior to this invention, practitioners have not been able to apply this principle to complex parts or materials where the cooling rate at the part's surface is not sufficient to keep the part in the Austenite phase before reaching the Martensite start temperature for that alloy.

The need exists, therefore, for an improved quenching process that yields grain transformation with hardened fine grains deep into a part made of a given alloy and yields predictable changes in the part shape and size as the part cools. Additional needs exist for a water or an environmentally friendly water based solution as the quenchant which reduces or even prevents film boiling on the surface of parts having non-uniform surfaces with thin and thick sections or small inside diameter (ID) holes (hollow shafts) or blind holes or pockets and/or is made of a low-alloy material or low hardenability material which moves from the Austenite phase to the intermediate phase very quickly.

SUMMARY

This specification discloses a process for quenching at least a portion of a hot metal part comprised of a Martensitic metal composition having a surface area, a surface temperature, and a critical cooling rate. The process may comprise the steps of contacting at least a portion of the surface area at an initial moment of contact with an aqueous quenchant wherein the aqueous quenchant contacts the portion of the surface area at an impact pressure greater than an aqueous quenchant pressure corresponding to a vapor pressure of the aqueous quenchant at the surface temperature of the portion of the surface area, and renewing the aqueous quenchant at the surface of the metal part.

It is further disclosed that the surface temperature of the hot metal part should be reduced at a cooling rate greater than or equal to the part's critical cooling rate and that the cooling rate is maintained for at least the time corresponding to an inflection point of a TTT diagram characterizing the Martensitic metal composition.

It is further disclosed that the renewal of the aqueous quenchant may be done using a controlled quenchant renewal.

It is further disclosed that the process may further comprise an aqueous quenchant source wherein there may be a valve having a valve closed position and a valve opened position separating the aqueous quenchant source from the hot metal part and that the aqueous quenchant may contact the hot metal part by evaporating a liquid or subliming a solid behind the aqueous quenchant in the aqueous quenchant source while the valve is in the valve closed position to create the aqueous quenchant pressure, changing the valve from the valve closed position to the valve opened position, and allowing the aqueous quenchant to contact the hot metal part at a cooling rate greater than or equal to the critical cooling rate.

That the liquid or solid may be selected from the group consisting of nitrogen, argon, helium, and carbon dioxide is also disclosed.

The cooling rate may be selected from the group consisting of at least 300° C. per second, at least 400° C. per second, at least 500° C. per second, and at least 600° C. per second.

Placing the hot metal part at least partially inside a quench chamber prior to contacting the hot metal part with the aqueous quenchant is also disclosed.

It is further disclosed that the contact of the hot metal part with the aqueous quenchant may be stopped at a quench stop time corresponding to a time at which a core of the hot metal part reaches its Martensite finish temperature.

The quench chamber may further comprise a coining die with nozzles coinciding with part geometry of the hot metal part.

It is further disclosed that there may be a plurality of exit nozzles within proximity of the part surface and the aqueous quenchant passes through at least a portion of the plurality of exit nozzles after contacting the portion of the surface area.

It is also further disclosed that contacting step may be preceded by a heating step and the amount of time between the heating step and the contacting step may be less than the time corresponding to an inflection point of a TTT diagram characterizing the Martensitic metal composition.

It is also disclosed that there may be no cooling between the heating step and the contacting step.

This specification further discloses a process for quenching at least a portion of a hot metal part comprised of a Martensitic metal composition having a part surface, a surface area, a surface temperature, and a critical cooling rate; comprises using a quench apparatus to accomplish the steps of contacting at least a portion of the hot metal part with a quenchant, and renewing at least a portion of the quenchant using a controlled quenchant renewal.

This quench apparatus may have at least one inlet nozzle and at least one exit nozzle.

The quench apparatus may be a coining die coinciding with a hot metal part geometry.

It is also disclosed that the hot metal part may be hollow with a hollow space and the quench apparatus may comprise at least a first zone fluidly isolated from a second zone with the quenchant entering the hollow space through the first zone and exiting the hollow space through the second zone.

This specification further teaches that the first zone and the second zone may be a first twisted tube twisted with a second twisted tube and that they may be twisted around each other as a twisted pair.

The specification further discloses that the hollow hot metal part may be a hot metal gun barrel or a hot metal axle.

Again, the process benefits from having no cooling take place between the heating step and the contacting step.

DETAILED DESCRIPTION

Description of Figure Nomenclature

Figure 5:
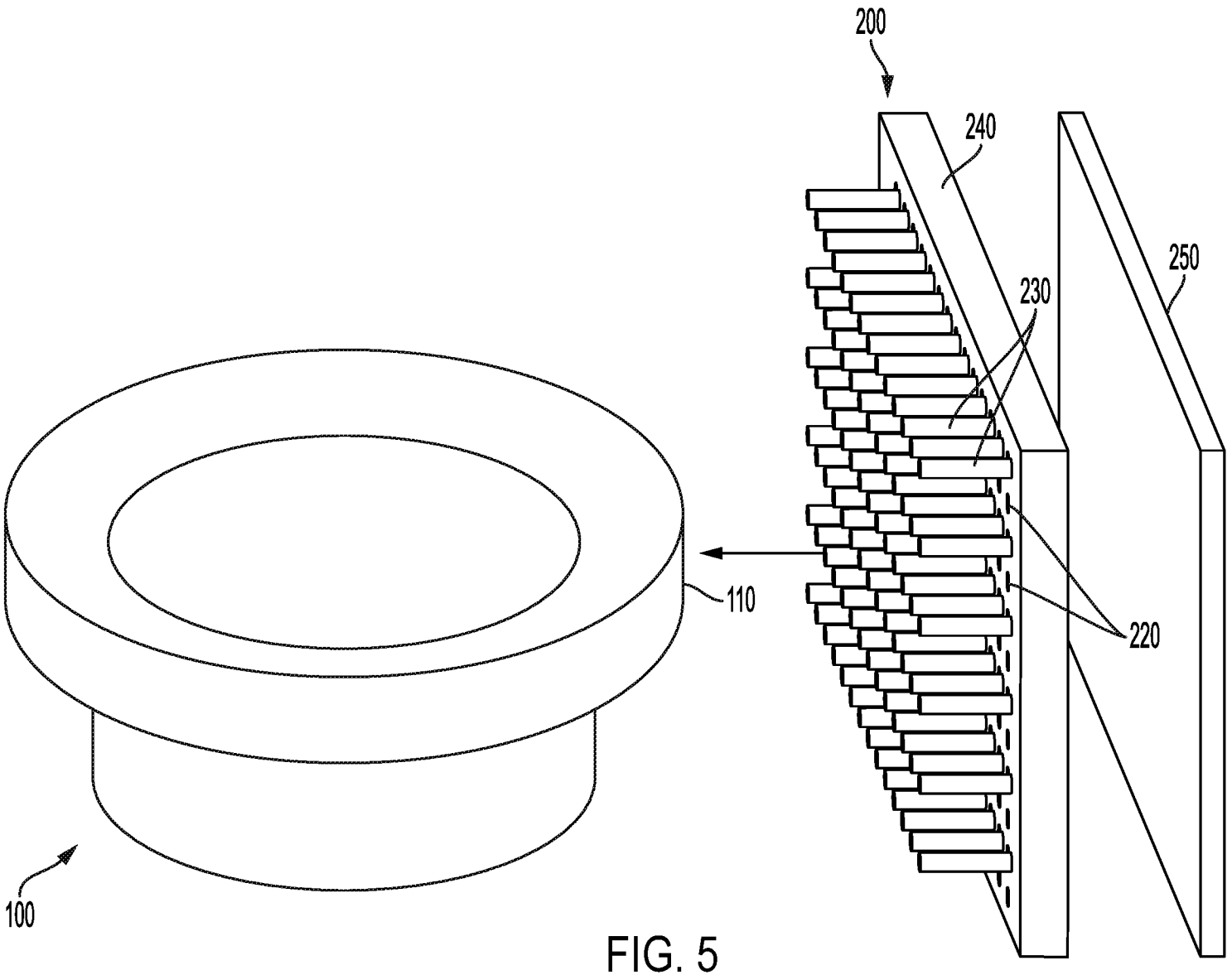
FIG. 5 depicts an application of the coining die described herein.

10 refers to the die.
20 refers to the exit nozzles.
30 refers to the inlet nozzles, also known as the entrance nozzles.
40 refers to the manifold of the die.
45 is the distance from the inlet nozzle and the part surface.
50 refers to the part surface.
60 refers to the point of contact of the quenchant on the part surface.
70 indicates the flow of the quenchant.
100 refers to the part.
110 refers to part surface to be quenched in FIG. 5.
200 refers to the die.
240 refers to the manifold.
220 refers to the exit nozzles.
230 refers to inlet nozzles or entrance nozzles.
250 refers to the back of the die.

The inventor has over 75 years of cumulative heat treating knowledge in his family's heat treating business and 20 years of experience applying the principles of the '974 Patent.

His observations over the years have established that the current methods of measuring, describing and controlling the quench process are inadequate and non-informative as to what is happening at the surface of the part during quench cooling. This is especially true at the granular level where the phase transformations occur. These deficiencies of the prior art as practiced and disclosed in the literature will be highlighted when the improvements are discussed in this specification.

Disclosed herein is a process for quenching a hot metal part which reduces, substantially eliminates, or even eliminates the problem of non-uniform film boiling on the surface of parts having complex geometries and complex surfaces. The process may comprise providing a controlled quenchant renewal at the part surface. The process may comprise, separately or in conjunction with the controlled quenchant renewal, exposing the hot metal part to a liquid quenchant in a quench chamber under a pressure at a surface of the hot metal part sufficient to reduce or even prevent film boiling.

These methods are believed to control the granular morphology changes in those first few milliseconds of initial contact of the quenchant with the part surface and during the quenching process.

It is believed that by pressurizing the liquid quenchant, the liquid quenchant can be uniformly and more quickly exposed to the part surface to achieve a much higher cooling rate than traditional quenching techniques, including those disclosed in the '974 Patent.

It has been discovered that a high cooling rate, which has come to be known as intensively cooling or intensively quenching, requires a uniform, i.e. controlled, quenchant renewal at the part's surface to treat complex parts.

The literature often describes a process as "uniform" or having a "uniform" cooling rate. However, the inventor's experience has found that uniform is a relative term, with processes being more uniform than others. As described below, the non-uniformity of the process believed to be uniform is intuitive and evidenced by distortion, part cracks, and highly variable stress levels across the surface through to the core. Recognizing that allegedly "uniform" prior art processes are not really uniform led in part to this invention.

For larger mass, non-complex parts like a plate or rod, a high quenchant mass velocity over the part's surface has proven to be sufficient. This is because the amount of time of film boiling is very small relative to the total time required to quench the part.

However, it should be noted that industry practices claiming to have a high quenchant velocity often do not have a high quenchant velocity at the part surface and certainly, not a uniformly high velocity across the surface, especially at the initiation and first few milli-seconds after the heating stops.

This is because the mass velocities are determined by using the volume displacement (l/min) times the specific gravity (kg/l) of the motivating force divided by the surface area of the exit from the motivating force ($m^2$). For example, a pump delivering 45 gallons per minute of water delivers 170 l (0.17 m3) or 170 kg of water per minute. If the water quenchant exits a 4 cm inside diameter (ID) nozzle (12.56 $cm^2$, 0.001256 $m^2$) then practitioners say the water quenchant has a linear velocity of 0.17/0.001256, or 135 m/min or 2.25 m/s linear velocity or 2250 g/s mass velocity. As this exercise points out, one has no idea what the velocity is at the part surface. This is particularly compounded when the liquid quenchant is motivated into a mass of quenchant.

A propeller suffers from the same deficiency. The velocity is calculated using the diameter of the propeller and the energy consumed. The velocity is never expressed at the part surface.

The same observation is noted for how the industry treats pressure. The quenchant's pressure is quoted as the pressure of the motivating force, such as a pump or the pressure at the exit of the nozzle. Unless specifically measured at the part surface, one has no idea the quenchant pressure at the part surface in heat treating practice.

Understanding the implications of industry practice and nomenclature are essential to distinguishing the parameters of this invention from the prior art. The deficiency can be best explaining by examining a pistol. When fired at a target through air, the bullet travels very fast and strikes the target with tremendous force (pressure). However, if the bullet is fired into a tank of water, such as the back of a toilet, the bullet can hardly travel to the other side. Knowing the velocity of the bullet and its pressure as it exits the barrel tells one nothing about the velocity and pressure only centimeters away when traveling through water.

Observation has determined that even if the quenchant may strike the surface at a high velocity, the quenchant will form eddies, pools, and stagnant areas such as one sees on a rock in a river. All of which create non-uniformity in the quench, particularly in the first few millisecond of quenching.

A high quenchant velocity is not enough to force the liquid quenchant into and around the complex surfaces of the part (i.e. the groove(s), blind hole(s), through hole(s), flanges, etc.) where film boiling would have occurred in the known processes. In fact, observation has shown that the high velocity makes the eddies and stagnant areas worse, increasing the amount film boiling. The inventor is also unaware of any literature discussing what happens to the quenchant after it contacts the part surface. It is assumed that the quenchant just moves away from the part making room for new quenchant thus "renewing" the quenchant at the surface of the part.

It has been discovered that the quenchant should also be removed from the surface and surrounding regions in a controlled manner as opposed to the prior art practices which "renew" the quenchant at the part surface in a random or uncontrolled manner. By localizing the removal of the quenchant, there will be less stagnant areas where the quenchant will overheat leading to film boiling in stagnant areas.

A controlled quenchant renewal, also described as a uniform quenchant renewal in this specification, is the positive non-random diversion or removal of the quenchant away from the surface of the part after the quenchant has contacted the part. A controlled quenchant renewal requires the positive application of at least one force to the quenchant other than the force causing the quenchant to contact the part's surface. The use of a tube to move the quenchant away from the surface of the part is an example. The force is the force of the tube directing and diverting the quenchant away from the surface. It applies a static force to the oncoming quenchant. If the tube has a lower pressure than the quenchant pressure at the surface of the part, the differential force causes the quenchant to lift off the part surface and travel away from the part surface.

Application of a turbine or agitator to a still bath does not create a controlled quenchant renewal at the part's surface. This is because the agitator or the turbine provides the force before the quenchant strikes the part surface.

The controlled quenchant renewal may only be applied to part of the surface. Therefore, at least a portion of the part surface may be quenched using a controlled quenchant renewal. Additionally, only a portion of the quenchant may be renewed using controlled quench renewal.

There is a time element of the controlled quenchant renewal. Because the grain transformations happen in the first milliseconds, the minimum time is from the start of the initial contact of the quenchant with the surface of the hot part to the time associated with the inflection point on the material's TTT diagram. While the practitioner can continue using the controlled quenchant renewal after that time, it is not essential. The Martensite is either forming by that time in the surface or the material is transforming into bainite or pearlite by conduction under the part's surface and controlled by the geometry of the part.

The hot metal part may be non-complex in that it is has a relatively simple surface geometry such as a straight bar, block or sphere. It is known that traditional quenching works for larger non-complex parts. However, the process is believed to be preferred for hot complex metal parts having complex surface geometry with any combination of surface features with thin and thick cross sections. Some common surface features found in complex parts include roots, flanks, and tips (such as those found on a gear), crevices, grooves (such as O-ring or snap-ring grooves), splines, flanges, blind holes, and through holes. Accordingly, a complex part is a part having at least one of a root, flank, and tip (such as those found on a gear), a crevice, a groove (such as O-ring or snap-ring grooves), splines, a flange, a blind hole, and a through hole.

One method to control film boiling is to control the pressure of the quenchant at the part surface. The pressure of the quenchant at the part surface is known as the impact pressure, or pressure at point of contact. The local pressure at the part surface will be equal to or greater than the liquid quenchant's vapor pressure at the surface temperature of the metal part. In this manner, it is believed that the liquid quenchant will not film boil. For example, a pan of water open to the atmosphere will never get hotter than 100° C. At 100° C., the water will boil. However, in a pressure cooker, where the water is held at a higher pressure, the water temperature will climb until its vapor pressure is at the pressure of the system. At this point, the water will boil, but at a much higher temperature. As a corollary, by keeping the pressure of the system greater than the vapor pressure of the water at the surface temperature of the part, the water should not boil.

This pressure, i.e. impact pressure, at the part surface can be achieved, for example, by pre-pressurizing the quench chamber. The pressure at the part surface can also be achieved by contacting the part surface with a high pressure jet of liquid quenchant, such as those found in a water-jet cutting machine, a high pressure washer or a nozzle which creates a lance of water. It is believed that the lance will have such a high pressure and that it will "cut" through any film boil insulating layer that may form around the part, causing it to nucleate boil. Whether the quenchant exiting the nozzle has to travel through a quenchant to reach a part is not relevant so long as the quenchant impact or pressure at the part surface is greater than the quenchant's boiling vapor pressure at the temperature of the part surface.

When a pressurized quench chamber is not desirable, the impact pressure is created by making sure the quenchant contacts the part surface at a pressure greater than the vapor pressure of the quenchant at the part's surface temperature at the point of contact.

The quenchant is preferably in its liquid state. A preferred liquid quenchant is water due to its high cooling capacity and low environmental impact. The liquid quenchant may also be a water-based solution, also known as an aqueous quenchant, comprising additives such as polymer based additives, salts or particulate additives. Accordingly, a water based quenchant, or aqueous quenchant, will preferably comprise at least 75% by weight water, with at least 80% by weight water being more preferred, with at least 90% by weight water being even more preferred, with at least 92% by weight water also being preferred.

A quench chamber refers to a vessel which is capable of holding the liquid quenchant and the hot metal part. The quench chamber preferably has a bottom, at least one side wall, a top, and a hollow interior. The specific configuration of the quench chamber is not believed important so long as the at least one side wall is sealed to the bottom. While it is preferred to seal the at least one side wall to the bottom to prevent leaks; the side wall, bottom or both may include an opening through which the liquid quenchant can escape from the quench chamber. Preferably this opening may be sealed during operation, such as by closing a valve at the opening. The quench chamber may be a pressurized quench chamber capable of maintaining a pressure above that of atmospheric pressure.

The process may also comprise a liquid quenchant source external to the quench chamber. The liquid quenchant source may be in fluid communication with the quench chamber. The liquid quenchant source is preferably capable of maintaining a pressure above atmospheric pressure.

The liquid quenchant source and the quench chamber may be separated by a valve. The valve may have a valve closed position and a valve opened position. The valve opened position is when the valve is not in the valve closed position. Therefore a valve opened position includes a valve that is halfway open. When the valve is in the valve closed position, the fluid communication between the quench chamber and the liquid quenchant source will be cut off, preventing the liquid quenchant from entering the quench chamber. When the valve is in the valve opened position, the fluid communication between the quench chamber and the liquid quenchant will be established, allowing the liquid quenchant to enter the quench chamber.

A liquid may be evaporated, (or alternatively a solid sublimed such as dry ice, e.g. $CO_{2(s)}$), behind the liquid quenchant in the liquid quenchant source to quickly increase the pressure. Preferably this will occur while the valve is in the valve closed position. The preferred liquid is liquid nitrogen. Examples of other liquids include liquid hydrogen, liquids of the noble gases such as argon or helium. The liquid may also be a combination of multiple liquids. For safety reasons, it is preferred that the liquid be of an inert compound. Evaporating the liquid behind the liquid quenchant will increase the pressure of the liquid quenchant. After all or a portion of the liquid is evaporated, the valve can be switched to the valve opened position such that the pressure forces the liquid quenchant into the quench chamber to contact the part surface at a pressure equal to or greater than the liquid quenchant's vapor pressure when at the surface temperature of the metal part.

Figure 1:
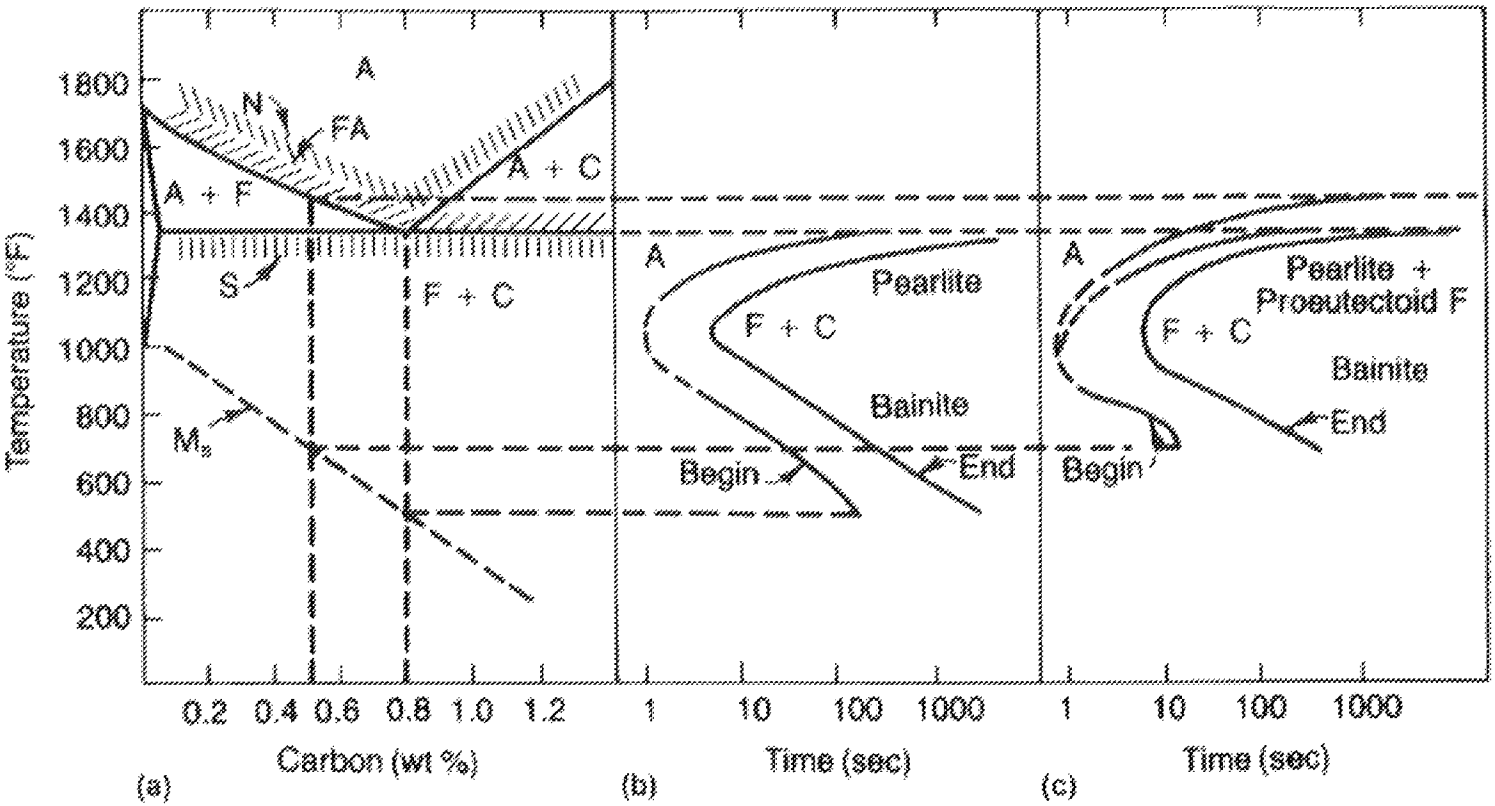
FIG.1 BACKGROUND ART
FIG. 1 depicts the relationship to (a) iron-carbon diagram of isothermal transformation of euctoid steel and steel containing 0.5% C.
Figure 2:
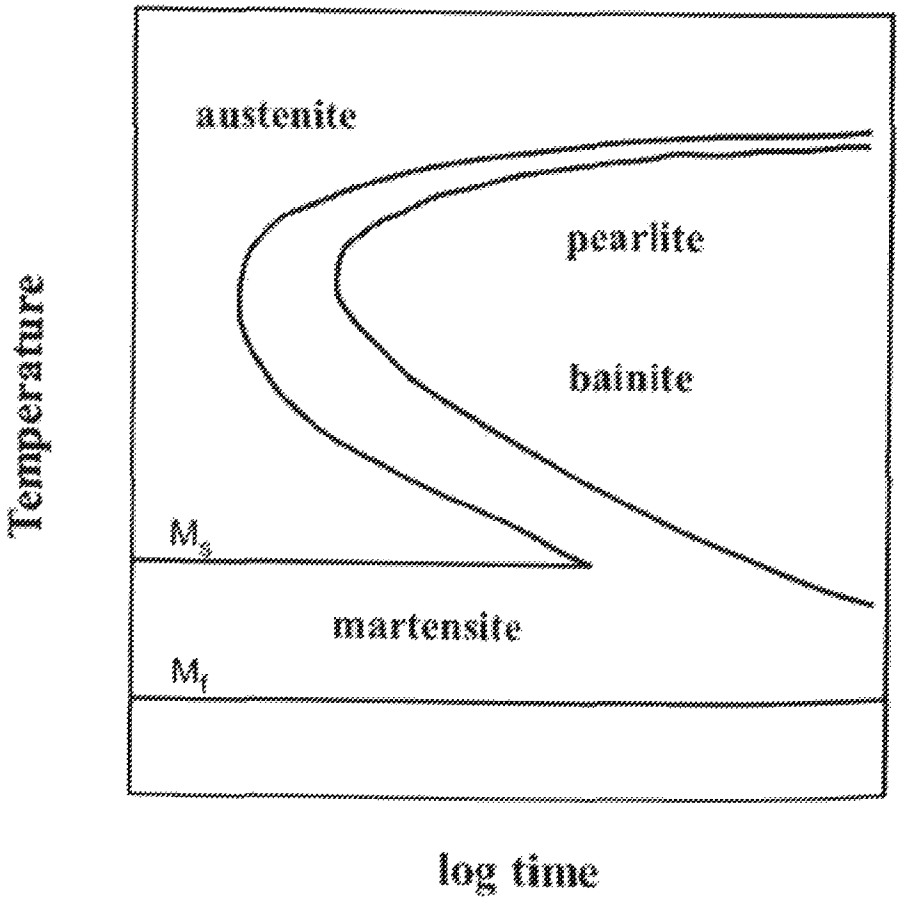
FIG.2 BACKGROUND ART
FIG. 2 depicts a schematic representation of a Time-Temperature-Transformation (TTT) diagram

The part surface cooling rate required is known as the critical cooling rate and is established by the inflection point on the TTT diagram of the material making up the part and the part's starting surface temperature. It can be seen from the TTT diagram of FIG. 1, which is applicable only to the material from which it was derived, that the inflection point occurs at approximately 1 sec and 1100° F. (593° C.). Assuming the starting surface temperature of the part is 1600° F. (871° C.), the required cooling rate to keep the surface of the part out of the intermediate phase is the surface temperature at the start (Ts) of the quench less the temperature of the inflection point (Ti) divided by the time of the inflection point (ti). In this case Ts=871, Ti=593 and ti=1 yielding a critical cooling rate of at least: [871−593]/1=278° C. per sec in order to miss the nose of the curve.

It is therefore important when one wants to establish compressive stresses to cool the surface of the part at a rate equal to or greater than the part's critical cooling rate for at least the amount of time corresponding to the inflection point (ti).

It is important to understand what happens in this one second. In many instances, it takes many seconds, sometimes 40 seconds to a minute, or more, to move the hot part from the heat source to the quench tank and begin the quenching cycle. However, there is an "air quench" occurring in the 40 seconds of transfer. But more importantly, if the rapid quench is not started before the time of the inflection point, non-uniformity of the quench begins to affect the layers below the surface.

While it is preferable that the critical cooling rate begin at a time less than the time associated with the inflection point (ti) (i.e. the quenchant's initial contact with the part surface occurs at a time less than the time associated with the inflection point (ti); it is most preferable to have no air quench, or no cooling, between the moment the heating stops and the part is contacted with the quenchant creating an instantaneous quench.

One way to accomplish this is to inductively heat the part and turn on the quench immediately or simultaneously with or prior to turning off the induction unit.

The part surface critical cooling rate may be a rate of at least 278° C. per second.

The part surface critical cooling rate may be a rate of at least 300° C. per second.

The part's surface cooling rate of at least 300° C. per second is established by many parameters known to those of ordinary skill. For example, the liquid quenchant itself will have a specific gravity, a temperature and a rate of thermal conductivity, the part surface will have thermal conductivity as well as the heat flow though the part. The temperature differential between the part surface and the liquid quenchant also plays a large role. The rate of liquid quenchant renewal at the part surface, which in some instances could be the mass velocity over the part, also plays a role. It is believed that the part surface cooling rate need only to be maintained for less than a second, or even a half a second. But the cooling rate of at least 300° C. per second is believed to be the minimum rate at the initial moment of contact of the liquid quenchant with the part surface. It is believed that one of the reasons for this high rate of cooling is to form the Martensite in the grains below the surface layer.

While a surface cooling rate of at least 300° C. per second is preferred, the surface cooling rate of at least 400° C. per second is even more preferred, with a surface cooling rate of at least 500° C. per second being even more preferred and a surface cooling rate of at least 600° C. per second being the most preferred.

For example, if the liquid quenchant is water, the preferred initial temperature of the water is at or near 3.9° C. This gives the water its highest density and highest resistance to vaporization from the application of heat.

Because of the role of Martensite in these parts, the hot metal part is to be a Martensitic metal, meaning that it is capable of forming Martensite. Some alloys do not form Martensite and it is believed they would not benefit from this process.

The hot metal part may be placed at least partially inside the quench chamber prior to the hot metal part being exposed to the liquid quenchant, in which case the process can be described as having at least three steps. First, the hot metal part is placed at least partially inside the quench chamber while the valve is in the valve closed position. Second, the liquid is evaporated behind the liquid quenchant in the liquid quenchant source to increase the pressure of the liquid quenchant. This second step can occur before, after, or simultaneously with placing the hot metal part at least partially inside the quench chamber. The third and final step involves changing the valve to the valve opened position and allowing the liquid quenchant to flow into the quench chamber at the liquid quenchant velocity. Preferably there is no liquid quenchant in the quench chamber prior to changing the valve to the valve opened position. If liquid quenchant is in the quench chamber prior to changing the valve to the valve opened position, said liquid quenchant should not come into contact with any portion of the surface of the Austenitized hot metal part until after the valve has been changed to the valve opened position allowing the liquid quenchant from the liquid quenchant source to flow at a liquid quenchant flow rate into the quench chamber Alternatively, the liquid quenchant can be introduced into the quench chamber prior to the hot metal part being exposed to the liquid quenchant, in which case the process can be described as having at least three steps. First, the liquid is evaporated behind the liquid quenchant in the liquid quenchant source to increase the pressure of the liquid quenchant while the valve is in the valve closed position. Second, the valve is changed to the valve opened position to allow the liquid quenchant to flow into the quench chamber at the liquid quenchant velocity. The third and final step involves placing the Austenitized hot metal part into the quench chamber. This final step should be conducted as soon as possible after changing the valve to the valve opened position. Preferably, the third step of placing the hot metal part into the quench chamber occurs simultaneously or substantially simultaneously with the second step of changing the valve to the valve opened position to allow the liquid quenchant to flow into the quench chamber at the liquid quenchant velocity.

Because the changes in the metal crystals' size, shape and stress states occur in milli-seconds, particularly for Martensitic steels, it is believed that the best results will be achieved when the Austenitized metal part's shell is uniformly contacted with the liquid quenchant at the initial moment of contact. Regardless of whether the hot metal part is placed inside the quench chamber prior to or after the liquid quenchant entering the quench chamber, it is preferred to instantaneously expose as much of the hot metal part's surface as possible to the liquid quenchant at the initial moment of contact and at the required cooling rate. E.g. uniform quench, uniformly quench, or uniformly contact.

Perfect uniform contact occurs when all the surface area of the part is contacted with the quenchant at the initial moment of contact. It is important to note that while much of this application is directed to a liquid quenchant, preferably water, the uniform contact is applicable to gas or vapor quenchant systems as well. When the word quenchant is used without the liquid preceding it, it means all quenchant types.

Put another way, uniformly contacted means that the quenchant instantaneously contacts a defined portion of the part surface area at the initial moment of contact. The following are examples of non-uniform contact. Slowly lowering the part into the quenchant using an elevator. In this example the quenching starts at the bottom surface of the part creating non-uniformity before the upper surfaces of the part are contacted with the quenchant. Another example involves placing a long piece, like an axle, into a tube and introducing the quenchant at one end of the tube. In this example, the first end of the metal part is already thermally shrinking before the quenchant even contacts the second end of the metal part.

This uniform contact is achieved by taking special measures to not only have the quenchant strike the metal part in a localized manner (i.e. many nozzles across the surface of the part and close to the part) but also by having localized quenchant renewal at the part's surface. This localized quenchant renewal can be done by placing many quenchant removal nozzles, also known as exit nozzles, throughout the nozzle schedule.

Figure 3:
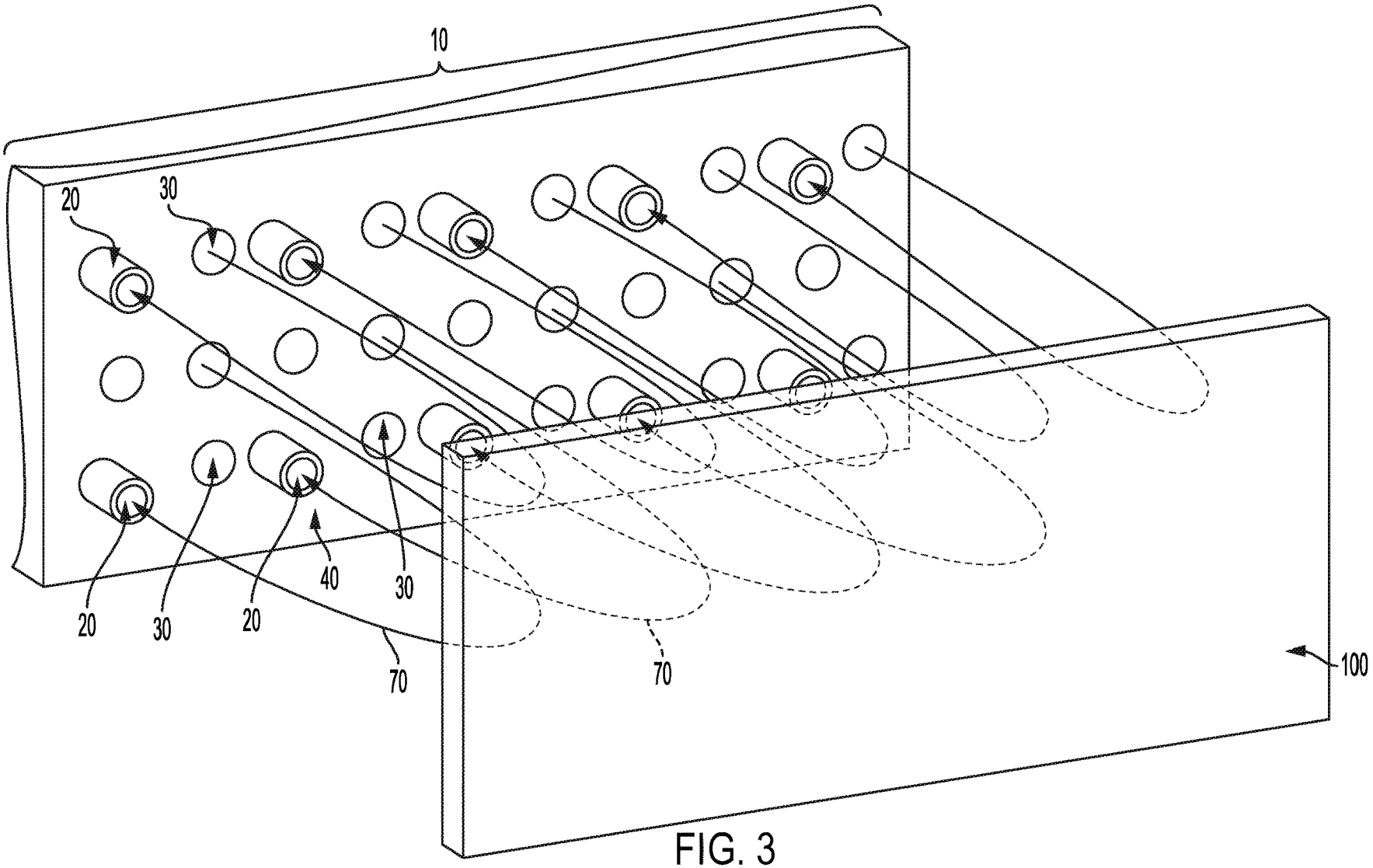
FIG. 3 depicts an embodiment of a nozzle schedule of a nozzle assembly for conducting a controlled quenchant renewal at the surface of the part.
Figure 4:
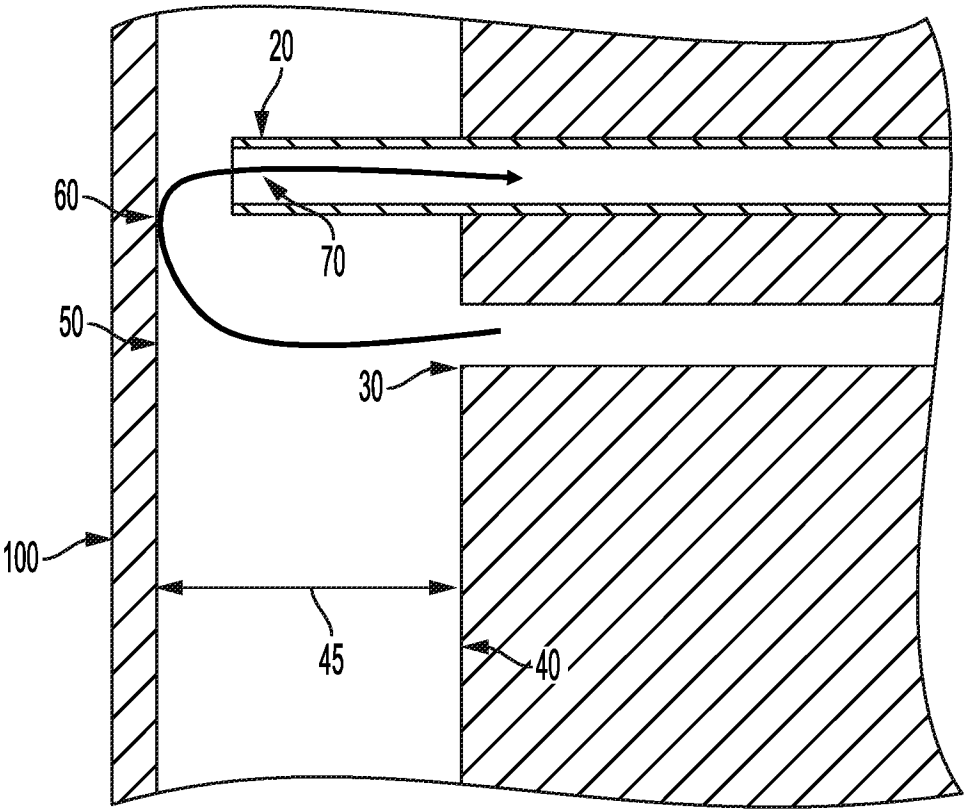
FIG. 4 depicts the quenchant flow pattern of the nozzle assembly.

FIG. 3 and FIG. 4 demonstrate such a nozzle assembly (10). In FIG. 3, the inlet nozzles, also known as entrance nozzles, (30) are depicted by the round unraised holes in the manifold (40). As mentioned earlier, these entrance nozzles do not need to be round, but could be in the form of a water-jet or lance. The exit nozzles (20) are shown in white as raised from the manifold.

This nozzle schedule is placed very close the metal part, and is preferably shaped to fit around the part as discussed later. It is preferred that the exit nozzles, which extend further from the manifold (40) than the inlet nozzles (30) are in contact with the metal part. Although not shown, the exit nozzles can have notches at the hole to keep the part surface from blocking the flow.

While the exit nozzles provide a force directing the quenchant away from the part surface and are thus causing a controlled quenchant renewal, it is envisioned that the exit nozzles can be attached to the inlet of a pump or have a vacuum placed on them so that the pressure at the exit nozzle is less than the pressure at the surface of the part. In this manner a controlled quenchant renewal is further improved. Were the exit nozzles not present, the used quenchant would be pushed away in a random manner someplace further away from the entrance nozzle. This random flow pattern has been observed to actually reverse flow during a quench cycle, hold up flow, and cause pockets of stagnant flow which means no new quenchant strikes the surface of the part at those locations.

By keeping the distance from the nozzles and the part small, the nozzle schedule will form an annulus around the metal part. The volume of the annulus is relatively small compared to the large "quench tanks" commonly used. Accordingly, there is only a relatively small amount of liquid quenchant. But, this small volume of liquid quenchant allows for controlling the pressure at which the quenchant strikes the metal part and its subsequent exit from the annulus. A small volume of quenchant is all that is needed at any given point in time because the heated quenchant is removed in a controlled manner and renewed with new colder quenchant at the surface of the part.

The liquid quenchant enters the annulus through entrance nozzles (30) preferably under high pressure. Preferably at a pressure greater than the vapor pressure of the liquid quenchant at the surface temperature of the metal part. Because the liquid quenchant is being removed from the annulus (i.e. a controlled quenchant renewal) through the multiple localized exit nozzles (20) that are localized at the part surface, new quenchant is uniformly being brought into contact with the surface of the part at a high rate. Thus, achieving a controlled quenchant renewal at the surface of the metal part that is substantially uniform, or uniform, across the whole part.

The rate of the quenchant renewal conducted by the controlled quenchant renewal is called the controlled quenchant renewal rate and is the volume of quenchant removed through a controlled quenchant renewal per unit time. The ratio of the controlled quenchant renewal rate to the rate of quenchant striking the surface will be a positive number less than or equal to 1.0 is excluded as that represents the absence of a controlled quenchant renewal as practiced in the prior art. The maximum value of 1 represents the case when all the quenchant is renewed via a controlled quenchant renewal. The ratio of the controlled quenchant renewal rate to the rate of quenchant striking the surface is preferably in the range of 0.5 to 1, more preferably 0.6 to 1, and even more preferably 0.6 to 1, with 0.8 to 1 being the most preferred range of the ranges listed.

While this nozzle schedule (assembly) can be placed around a fixed part, it is also envisioned, that the metal part can be moved up and down or rotated inside a nozzle schedule arranged as described. Alternatively, the nozzle assembly could rotate around a metal part or move horizontally or vertically relative to the part.

FIG. 4 depicts how the nozzle assembly facilitates the uniform localized quenchant renewal at the surface (60). The quenchant flow pattern (70) enters the annulus (45) through nozzle (30), striking the surface of the part (50), then is removed via exit nozzle (20).

Alternatively, the entrance, or inlet, nozzle may extend past the exit nozzle, such as when the distance between the manifold and part is longer, or it is impossible to get the exit nozzle close enough to the part. In this embodiment, the quenchant is introduced almost directly at the part surface, and then pushed away by the new quenchant as it exits through the exit nozzle.

While the most preferred embodiment is the perfect, uniform quench which will involve instantaneously contacting all of the surface area at the initial moment of contact, it is believed that the quench can still be sufficiently uniform in other preferred embodiments. For example, at least 90% of the surface area of the hot metal part is exposed to the quenchant at the initial moment of contact. In another example, at least 95% of the surface area of the hot metal part being exposed to the quenchant at the initial moment of contact is more preferred. In still another example, at least 97.5% of the surface area of the hot metal part being exposed to the quenchant at the initial moment of contact is still more preferred. In yet another example, at least 99% of the surface area of the hot metal part being exposed to the quenchant at the initial moment of contact is even more preferred. Again, the most preferred example is 100% of the surface area of the hot metal part being exposed to the quenchant at the initial moment of contact.

The total surface area of the part exposed to the quenchant can also be expressed as a range. For instance, the amount of surface area of the hot metal part exposed to the quenchant can be in a range selected from the group consisting of from 90% to 100%, from 92.5% to 100%, from 95% to 100%, from 97.5% to 100%, from 99% to 100%, from 92.5% to 99%, from 92.5 to 97.5%, from 92.5% to 95%, from 95% to 99%, and from 95% to 97.5%.

It is believed that special quench chambers may be needed for uniform and instantaneous contact, especially for parts of complex shapes (rings with grooves or flanges). For example, a series of nozzles that surround the part and impinge at high pressure the surface area of the part at the same time is an embodiment. In this case, the part is placed into the center of the nozzle assembly, which is configured to the complex geometry of the part to achieve the uniform quench.

The quenchant may flow directly or indirectly into the quench chamber. In the case of direct flow, the fluid communication goes straight from the quenchant source to the hollow interior of the quench chamber separated only by the valve which is in the valve opened position. In the case of indirect flow, the fluid communication passes through another device (other than the valve) prior to the quenchant reaching the hollow interior of the quench chamber. Examples of other devices include at least one manifold connected to at least one nozzle. The at least one manifold can comprise a plurality of manifolds. The at least one nozzle can comprise a plurality of nozzles. Each manifold in the plurality of manifolds can also comprise a plurality of nozzles. Each individual nozzle in the plurality of nozzles may have a nozzle configuration selected from the group consisting of parallel to the quench chamber bottom, perpendicular to the quench chamber bottom, angled downward from parallel to the quench chamber bottom, and angled upward from parallel to the quench chamber bottom. The nozzles are not required to all have the same configuration. For instance, a first portion of the plurality of nozzles can be angled downward from parallel to the quench chamber bottom while a second portion of the plurality of nozzles is angled upward from parallel to the quench chamber bottom. The number and configuration of manifolds, and the number and configuration of nozzles can vary depending upon the size and shape of the quench chamber, and the size and shape of the metal part being quenched.

Another variant is the use of a coining die. A coining die is a well-known die which clamps the metal part and keeps the metal part under very high pressure to deform the metal. In this instance, the coining die is not used to shape the part, but to stabilize the part as it is quenched and changes volume over time as the part cools. The preferred coining die will have nozzles coinciding with, or configured to, the part geometry so that in addition to the pressure of the die itself, the high pressure quenchant will be passed over the part surface under high pressure at a rate necessary to achieve the minimum cooling rate within the annulus around the part. Configured to the geometry of the part means that the blind holes, grooves, valleys and intricate structures are flushed with quenchant and not trapped with stagnant vapor or gas.

Figure 6:
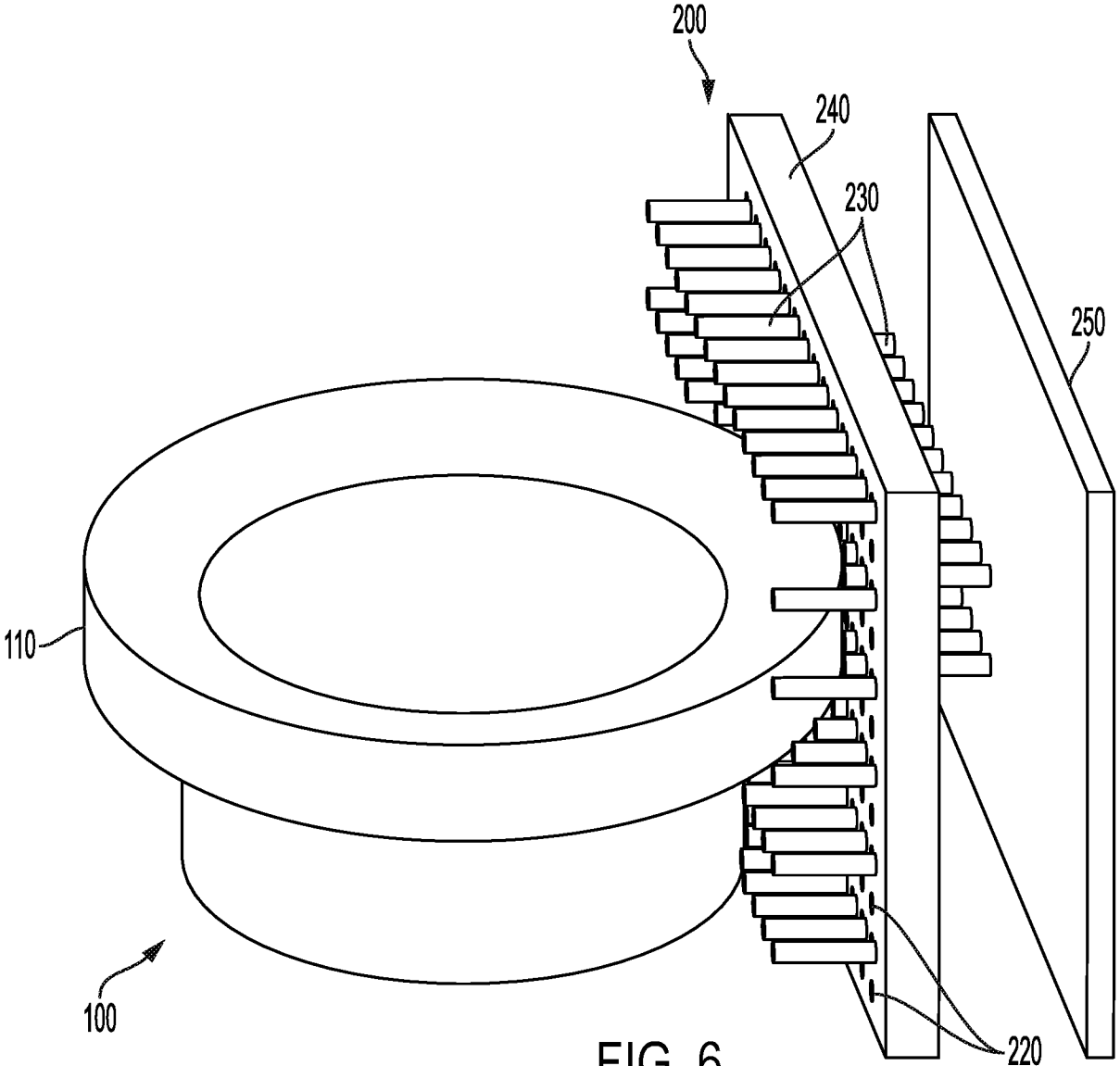
FIG. 6 depicts a further application of the coining die described herein.
Figure 7:
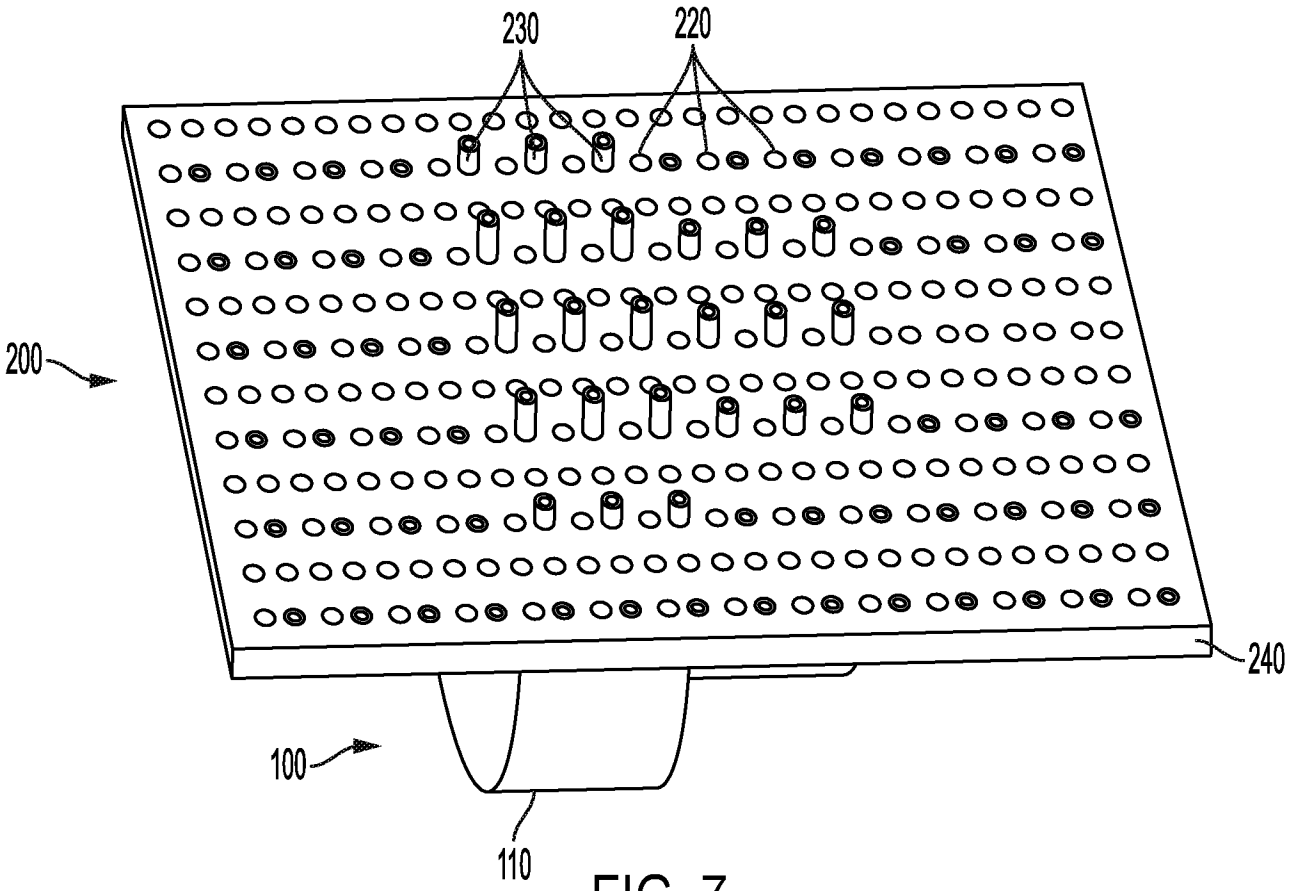
FIG. 7 depicts a reverse image from the back side of the coining die described herein.

FIGS. 5 to 7 show the application of the coining die. FIG. 5 depicts the metal part (a valve seat) (100) on the left with its flange and surface to be quenched (110) and the simulated coining die on the right (200). 250 points to the back of the die shown in exploded view. FIG. 6 shows how the valve seat mates with the die. In the particular coining die, each pin (230) would comprise a nozzle for the liquid quenchant to impinge upon the part surface and areas contiguous to the nozzles. The open areas (220) would allow for the controlled removal of the liquid quenchant from the surface of the part and out of the coining die. The nozzle may be sized to achieve the desired cooling rate for the part surface. FIG. 7 shows the backside of the pin rack and shows the inverted image of the valve seat on the side facing the valve. FIG. 7 also shows the complex nature of the flange on the valve seat. Like the die previously discussed, the coining die will have exit holes placed throughout the manifold.

For example, the nozzle for a blind hole will pass the liquid quenchant into the hole from one side of the entrance and flush the liquid quenchant out the other side of the entrance, not trapping the liquid at the center where the initial liquid quenchant would be trapped and risk boiling.

As another example, for a part having a through hole such as a long tube or an axle, the inlet nozzle will enter the inside diameter of the through hole. The inlet nozzle may have multiple perforated holes in its wall in order to obtain instantaneous quenching of the inside diameter of the through hole. The outside wall of the part containing the through hole will have its own set of nozzles. In this manner, one will obtain simultaneous quenching of the inside diameter of the through hole and the outside surface of the part. For through hole parts, one can even stage the quench so that the inside quench cooling starts first or the outside quench cooling starts first to control the stress states and part distortion.

In a large enough ID (inside diameter) tube, like a gun barrel or hollow axle, the controlled quenchant renewal is achieved by using at least two perforated tubes, preferably twisted for smaller diameter tubes. The first perforated tube is the inlet tube which injects the quenchant into the tube. Because the inlet tube is perforated along the length of the tube the quenchant can contact the whole inside surface instantaneously. The length of the hollow space is its depth from the surface to the end of the hole. In the case of a blind hole the length is the hole depth from the surface. In a through hole, the end of the hole is where the hole opens at a different part of the surface and the distance from one part of the surface to the other end of the part through the hole in the part is the length of the hollow space. Rather than letting the quenchant randomly flow and exit the ends of the barrel; the second perforated tube, the exit tube, removes the quenchant all along the tube length providing a more uniform quench throughout the inside of the tube. While two separate perforated tubes is an embodiment, the process generally comprises two fluidly isolated zones in the hollow space of the part with the inlet zone having multiple perforations along the length of metal part and the exit zone having multiple perforations along the length of the metal part. The first zone and the second zone are a first twisted tube twisted with a second twisted tube and they may be twisted around each other as a twisted pair.

The apparatus can also be described as being applicable to a hot metal part which is hollow with a hollow space and the quench apparatus has at least a first zone fluidly isolated from a second zone with the quenchant entering the hollow space through the first zone and exiting the hollow space through the second zone.

The pressure and velocity of the liquid quenchant as it enters the quench chamber will cause agitation of the liquid quenchant at or around the surface of the hot metal part. Without wishing to be bound by any theory, it is believed that the faster the renewal of the liquid quenchant at the part surface, the less film boiling will be experienced. One way to increase the renewal of the liquid quenchant at the part surface is to agitate the quenchant at or around the surface of the hot metal part by moving the part or moving the nozzles relative to each other. The rate of agitation (surface renewal or quenchant renewal rate) needed to reduce or prevent film boiling at a given pressure will depend, at least in part, upon the surface features of the hot metal part, the mass of the hot metal part, as well as the surface temperature of the hot metal part and the temperature of the quenchant. Preferably, the pressures at the surface of the part and of the liquid quenchant are the same over the entire surface of interest of the hot metal part during the quenching.

Pulsing the rate of surface renewal, for example by varying the upstream injection of the vaporizing propellant (liquid nitrogen or dry ice) or passing the liquid quenchant through a chopper valve before the quenchant contacts the surface of the part, is another example of increasing the uniformity of the renewal of the liquid quenchant at the part surface.

As it is believed that uniformly quenching under pressure will eliminate the film boiling, it is believed that the need to interrupt the quench is eliminated as currently practiced and described in the '974 Patent. Therefore, the process may proceed without interrupting the quench at the time specified in the prior art '974 Patent.

However, if desired, the practitioner may still wish to interrupt the quench at a quench stop time. Interrupting the quench simply means that the hot metal part is no longer being exposed to the liquid quenchant. This can be achieved in any number of ways such as removing the liquid quenchant from the quench chamber, removing the hot metal part from the quench chamber, or both. While small amounts of residual liquid quenchant may remain on all or a portion of the surface of the hot metal part, the hot metal part should no longer be submerged in the liquid quenchant once the quench stop time is reached.

The quench stop time or interruption time may correspond to the time at which the surface of the hot metal part reaches its Martensite finish temperature ($M_F$). The martensite finish temperature is well known in the art, and varies depending on the type and alloy of the metal used in the hot metal part. While the surface of the hot metal part will reach the martensite finish temperature, it is preferred that the interruption occur prior to the parts core reaching its Martensite finish temperature. The part should be tempered as soon as practical to temper the Martensite at the surface and achieve the desired level of hardness for the next step of the process.

It has been found that once the quenchant renewal at the part surface is controlled, i.e. not random, the "current" compressive stresses build rapidly and remain as residual stresses creating a very different hardened part. Additionally, the part will distort at the same locations as it thermally cools in a consistent manner. This consistent distortion makes the distortion predictable and allows one to shape the untreated part so that when the part is heated and quenched, the part distorts into the desired shape eliminating, or at least reducing post heat treatment steps such as grinding or straightening, flattening or otherwise bending into shape.

While the high pressure at the surface area benefits water quenchants, it is not necessary for oil. It is especially not beneficial for salt quenchants which do not boil or air which is already a vapor.

The controlled quenchant renewal is applicable to all quenchants, even air and vacuum systems. As air exhibits fluid flow characteristics, it too sets up stagnant zones causing non-uniform cooling of the part. By controlling the renewal of the air quenchant, the stagnant zones are eliminated or certainly minimized.

I claim:

1. A process of quenching a complex steel part, formed of a material and having a surface with features, from an austenitized structure at a temperature above a point of inflection for the material to a temperature below its Martensite start temperature, at a quenching cooling rate, where time-temperature-transformation data for the material includes the point of inflection and includes a critical cooling rate, the process comprising:

controlled quenchant renewal including:

simultaneously:

contacting a plurality of featured locations on the surface of the complex steel part with aqueous quenchant at an impact pressure greater than a vapor pressure of the aqueous quenchant at the surface of the part, the impact pressure created by a first force; and suctioning the plurality of featured locations thereby removing post-contact quenchant at the plurality of featured locations;

wherein the contacting and removing maintain the quenching cooling rate at a rate greater than or equal to the critical cooling rate for a quenchant renewal time period that is at least from a starting time of the contacting to a time of the Martensite start temperature;

the process further comprising:

providing a plurality of exit nozzles;

providing a plurality of inlet nozzles interposed with the plurality of exit nozzles, the pluralities of exit and inlet nozzles effecting a nozzle assembly; and moving at least one of the complex steel part and the nozzle assembly so that the plurality of exit nozzles are adjacent the surface of the complex steel part;

wherein a second force creates the suctioning by causing the exit nozzles to have a lower pressure than quenchant pressure at the part surface, openings of the exit nozzles providing respective pressure differentials distributed along the part surface causing post-contact quenchant to lift off the part surface and travel away from the part surface via the exit nozzles wherein the complex steel part includes a hollow tube, and wherein the moving of at least one of the complex steel part and the nozzle assembly positions the nozzle assembly inside the hollow tube, and wherein the nozzle assembly is configured as a pair of perforated tubes adjacent one another, and wherein the plurality of exit nozzles are disposed at periodic intervals along one perforated tube and the plurality of inlet nozzles are disposed at periodic intervals along the other perforated tube.

2. The process of claim 1, wherein the pair of perforated tubes are twisted about one another.

* * * * *